US005224370A

United States Patent [19]

Morita

[11] Patent Number: 5,224,370

[45] Date of Patent: Jul. 6, 1993

[54] LEAF SPRING CAMBERING APPARATUS

[75] Inventor: Motoo Morita, Nagoya, Japan

[73] Assignee: Morita and Company Co., Ltd., Aichi, Japan

[21] Appl. No.: 997,786

[22] Filed: Dec. 29, 1992

[30] Foreign Application Priority Data

Sep. 24, 1992 [JP] Japan ..... 3-280443

[51] Int. Cl.[5] ..... B21D 37/02

[52] U.S. Cl. ..... 72/413; 72/473; 72/482

[58] Field of Search ..... 72/413, 473, 482; 29/173

[56] References Cited

U.S. PATENT DOCUMENTS

| | | | |
|---|---|---|---|
| 1,272,531 | 7/1918 | Riley | 72/413 |
| 1,331,630 | 2/1920 | Elkins | 72/413 |
| 1,465,152 | 8/1923 | Williams et al. | 72/413 |
| 1,776,082 | 9/1930 | Peterson | 72/413 |
| 4,976,125 | 12/1990 | Wilson | 72/413 |
| 4,987,760 | 1/1991 | Schulte | 72/413 |
| 5,187,969 | 2/1993 | Morita | 72/413 |

*Primary Examiner*—P. W. Echols

*Attorney, Agent, or Firm*—Koda and Androlia

[57] ABSTRACT

Disclosed is a cambering apparatus for imparting a predetermined camber to a leaf blank for a laminated spring, which requires no change-over of molds in accordance with order changes, whereby to reduce the change-over time greatly to improve productivity. The cambering apparatus comprises a reformable mold, constituting a cope, having a plurality of adjustable mold members connected to one after another in such a way that their postures can be adjusted and locked; a pair of flexible plates disposed on each side of the row of the adjustable mold members; a couple of reforming devices each having engageable devices for movably engaging with the flexible plates, which impart a required profile to the flexible plates; and a pressing device, constituting a drag, disposed to oppose the reformable mold, for pressing said leaf blank placed therebetween against the reformable mold; wherein by imparting a predetermined camber profile to the flexible plates with the reforming devices, the free ends of the adjustable mold members disposed to the flexible plates, opposing to the pressing device, are designed to present as a whole a continuous curve corresponding to the profile of said flexible plates.

4 Claims, 7 Drawing Sheets

LEAF SPRING CAMBERING APPARATUS

BACKGROUND OF THE INVENTION

This invention relates to a leaf spring cambering apparatus, more particularly to a cambering apparatus for imparting necessary cambers to the leaf blanks for a leaf spring or laminated spring, which requires no change-over of molds in accordance with order changes whereby to drastically reduce change-over time and improve productivity.

Suspension systems consisting of a plurality of leaves 10 which are laminated and bound as shown in FIG. 7 are suitably employed in land transportation vehicles such as railway cars and trucks. Each of the leaves 10 can be prepared, for example, after formation of an eye at one end portion or each end portion of a rolled plate blank having a predetermined thickness or a taper at the other end portion thereof, by subjecting the thus processed blank, which is heated entirely, to a cambering treatment so as to be provided with a predetermined camber. The camber to be imparted to the blank varies depending on the application and load stress: a type in which the camber angle gradually diminishes or increases from the center toward each end and a type in which the middle portion has no camber.

FIG. 8 shows one example of prior art cambering apparatus 12 for imparting a camber to a leaf blank 10. The cambering apparatus 12 basically consists of a cope 14 and a drag 16. The cope 14 is a female mold, whereas the drag 16 is a male mold. A straight leaf blank 10 heated to a hot working temperature is placed between the cope 14 and the drag 16, and then the cope 14 is forced to approach the drag 16 to impart a camber comforting to the profile of these molds.

The mode of manufacturing leaves 10 includes:

(1) Group production mode in which leaves 10 of the same shape and the same specifications are continuously manufactured by the group lot; and (2) Family production mode in which a main leaf 10 and the other leaves 10 constituting a suspension system are manufactured by the family lot. A suitable production mode is selected by users depending on the application and other factors. In the group production mode, after a predetermined lot number of leaves 10 of the same shape are manufactured, the cope 14 and the drag 16 in the cambering apparatus 12 are changed only when different camber profile is to be imparted in accordance with the order change. It generally takes much time for the change-over of molds, which is a main factor of notably reducing efficiency in cambering leaf blanks 10. Particularly today when small lot production is prevalent, countermeasures must be taken for possible frequent order changes, and it is becoming extremely important to minimize the mold change-over time in the laminated spring industry.

Meanwhile, in the family production mode, each time a leaf blank 10 is cambered, the cope 14 and the drag 16 must be changed, since the camber to be imparted to each leaf blank is slightly different. Accordingly, this mode also suffers a disadvantage in that it requires extremely intricate procedures and consumes a considerable loss time. In this regard, the conventional cambering apparatuses are far from satisfactory for meeting the demand of the industry. Further, various kinds of copes 14 and drags 16 corresponding to the different camber profiles are necessary in both the group production mode and the family production mode, leading to production cost elevation. Moreover, inconveniences can be pointed out that the copes 14 and drags 16 must be stored separately, so that a wide space is required for the storage of these molds and that inventory control becomes troublesome.

On the other hand, the cope 14 and drag 16 wear with time at the molding surfaces and are deformed after a long time of use to be sometimes unable to impart a proper camber to leaf blanks 10. In such cases, while the cope 14 and drag 16 must be repaired or replaced with new ones, which takes a considerable time and is a factor of lowering productivity.

OBJECT AND SUMMARY OF THE INVENTION

The present invention is proposed in view of the problems inherent in cambering the leaf blanks for a laminated spring and for solving them successfully, and it is an object of this invention to provide a novel cambering apparatus for imparting cambers to the leaf blanks for a laminated spring, which can improve productivity by greatly reducing the time required for change-over of molds in accordance with the order changes.

In order to overcome the above problems and attain the intended objects, the present invention provides a cambering apparatus for imparting a predetermined camber to a leaf blank for a laminated spring, comprising:

a reformable mold having a plurality of adjustable mold members connected to one after another in such a way that their postures can be adjusted, each adjustable mold member being able to be locked in a predetermined posture;

a pair of flexible plates disposed on each side of the row of adjustable mold members and secured by each of them;

a couple of reforming devices each having engageable means for movably engaging with the flexible plates, which impart a required profile to the flexible plates by moving the engageable means in the longitudinal direction as well as in the camber imparting direction; and a pressing device disposed to oppose the reformable mold, for pressing a leaf blank placed therebetween against the reformable mold;

wherein by imparting a predetermined camber profile to the flexible plates with the reforming devices, the free ends of the adjustable mold members disposed to the flexible plates, opposing to the pressing device are designed to present as a whole a continuous curve corresponding to the profile of the flexible plates.

BRIEF DESCRIPTION OF THE DRAWINGS

The features of this invention that are believed to be novel are set forth with particularity in the appended claims. The invention, together with the objects and advantages thereof may best be understood by reference to the following description of the preferred embodiments taken in conjunction with the accompanying drawings in which:

DETAILED DESCRIPTION OF PREFERRED EMBODIMENT

The cambering apparatus according to the invention will now be described by way of a preferred embodiment referring to the attached drawings.

(Entire constitution)

Figure 1:
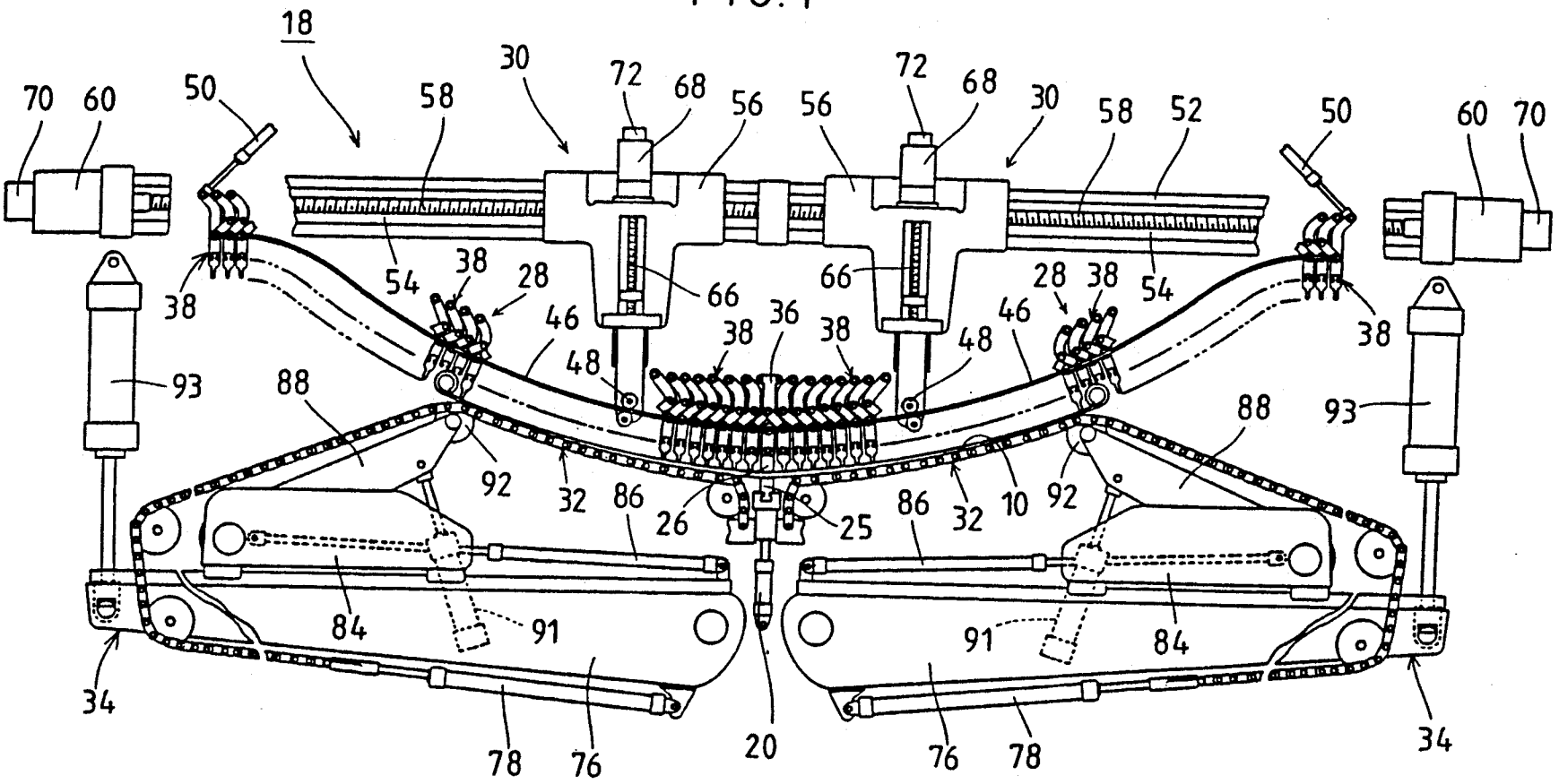
FIG. 1 shows, in schematic constitutional view, a cambering apparatus for imparting cambers to leaf blanks for a laminated spring according to one embodiment of the invention.

FIG. 1 shows in schematic constitutional view a preferred embodiment of a cambering apparatus according to the invention. The cambering apparatus 18 has a positioning cylinder 20 disposed perpendicularly at the center of the apparatus, and the free end of the piston rod 20*a* thereof directing upward is connected to the lower end of a carrier 24 disposed ascendably between a pair of fixed members 22 of the apparatus. A T-shaped guide groove 24*a* is defined invertedly on the upper surface of the carrier 24, in which a supporting finger 25 is slidably fitted. A leaf blank 10 forwarded from the previous step by a transferring device (not shown) such as a manipulator is loaded at the longitudinal middle portion on the supporting finger 25 and is designed to be held between the supporting finger 25 and a reference finger 26 (to be described later) disposed above the supporting finger 25 to be positioned and securely held thereby. On each side relative to the positioning cylinder 20, disposed are a reformable mold 28 constituting a cope, reforming devices 30 which impart a required profile to the reformable mold 28, variable mold members 32 together constituting a drag and operating devices 34 which allow the variable mold members 32 to conform with the profile formed by the reformable mold 28 to effect cambering of the leaf blank 10. The reformable mold 28, reforming devices 30, variable mold members 32 and operating devices 34 are disposed symmetrically in the apparatus relative to the center thereof, so that only those disposed in the right side will be described.

(Reformable mold)

Figure 2:
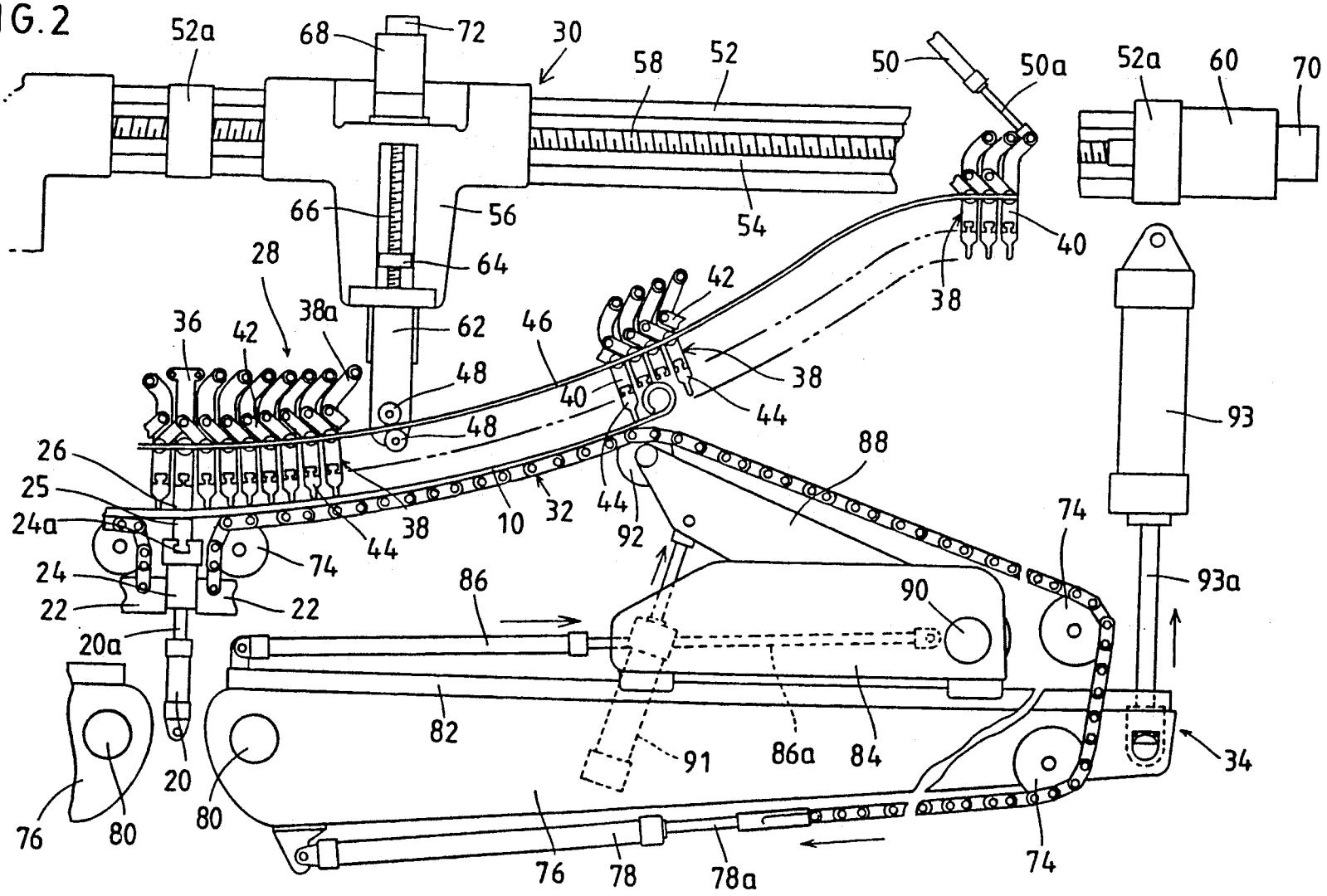
FIG. 2 shows schematically, in enlarged partial constitutional view, the cambering apparatus, illustrating more specifically, the reformable mold, the reforming device, the adjustable mold members and the operating device disposed on the right side of the cambering apparatus.

A T-shaped reference mold member 36, which is a member of the reformable mold 28, is positioned and fixed immediately above the positioning cylinder 20, as shown in FIG. 2, and a T-shaped guide groove 36*a* is defined at the lower end of the reference mold member 36 to extend in the transversal direction of the leaf blank 10. A reference finger 26 is slidably fitted in this guide groove 36*a*, so that the leaf blank 10 placed on the supporting finger 25 in the carrier 24 mounted on the cylinder 20 can be positioned and securely held between the supporting finger 25 and the reference finger 26 by operating the cylinder 20 to extend the piston rod 20*a* thereof. Incidentally, the supporting finger 25 and the reference finger 26 are removably attached to the carrier 24 and the reference mold member 36, respectively, so that they can readily be replaced with new ones when they are worn after a long time of use.

Figure 3:
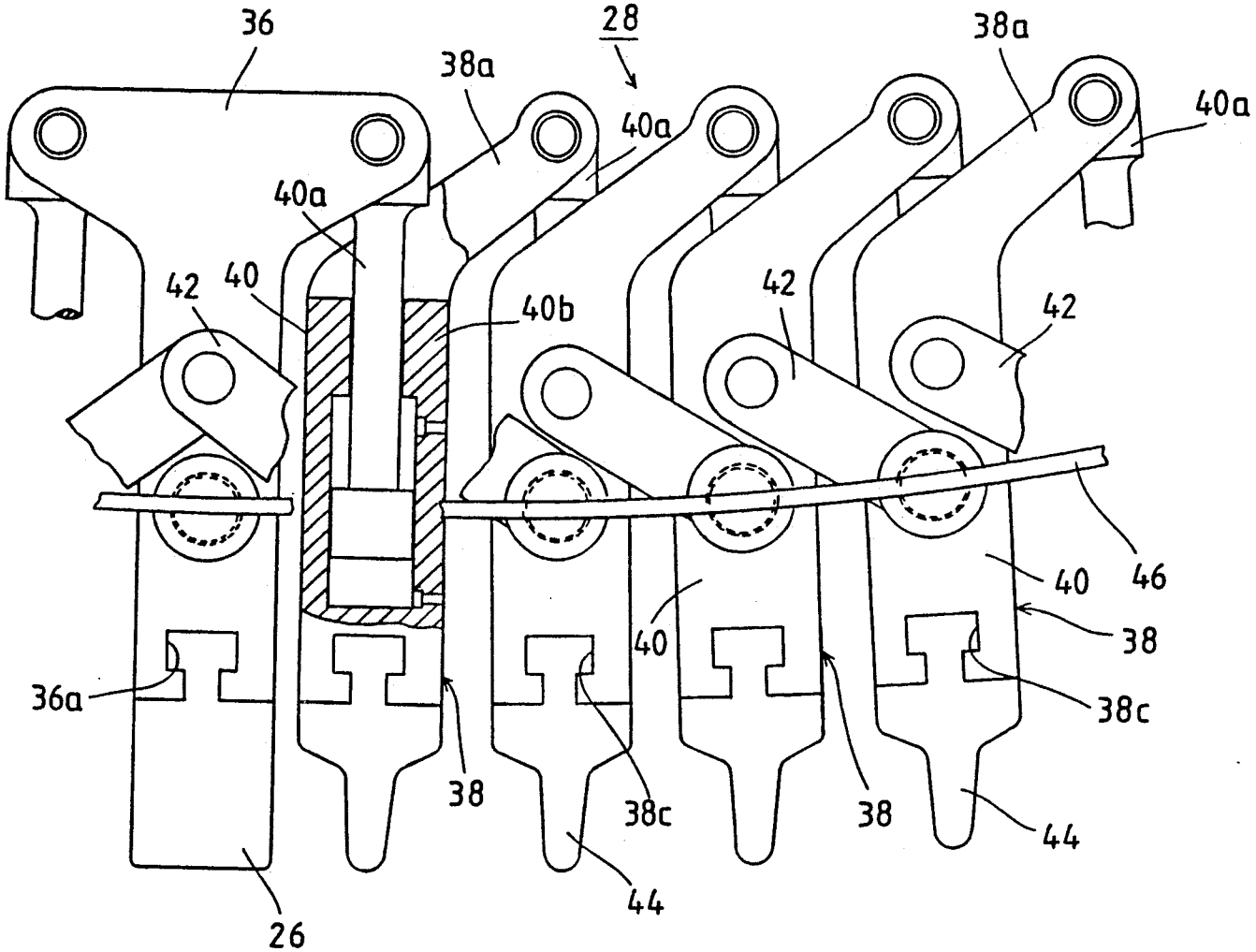
FIG. 3 shows schematically, in partially cutaway constitutional view, the major portion of the reformable mold.

The reference mold member 36 has a plurality of adjustable mold members 38 connected thereto one after another in the longitudinal direction of the leaf blank 10 in such a way that their postures can be adjusted so as to form a necessary camber profile by the lower ends of the group of adjustable mold members 38. Each adjustable mold member 38 is provided with a hydraulic cylinder 40 with its piston rod 40*a* extending upward, as shown in FIG. 3. The cylinder 40 is adapted to be shifted between a free state where the piston rod 40*a* can be moved and a locked state where the piston rod 40*a* cannot be moved. The upper end of the piston rod 40*a* of the adjustable mold member 38 locating adjacent to the reference mold member 36 is pivotally supported onto the head of the reference mold member 36. A pair of arms 38*a* extend diagonally upward from the head of the barrel 40*b* of the hydraulic cylinder 40 to direct farther from the reference mold member 36, and the upper end portion of the piston rod 40*a* of another adjacent adjustable mold member 38 is designed to be pivotally supported between the free end portions of these arms 38*a*.

Figure 4:
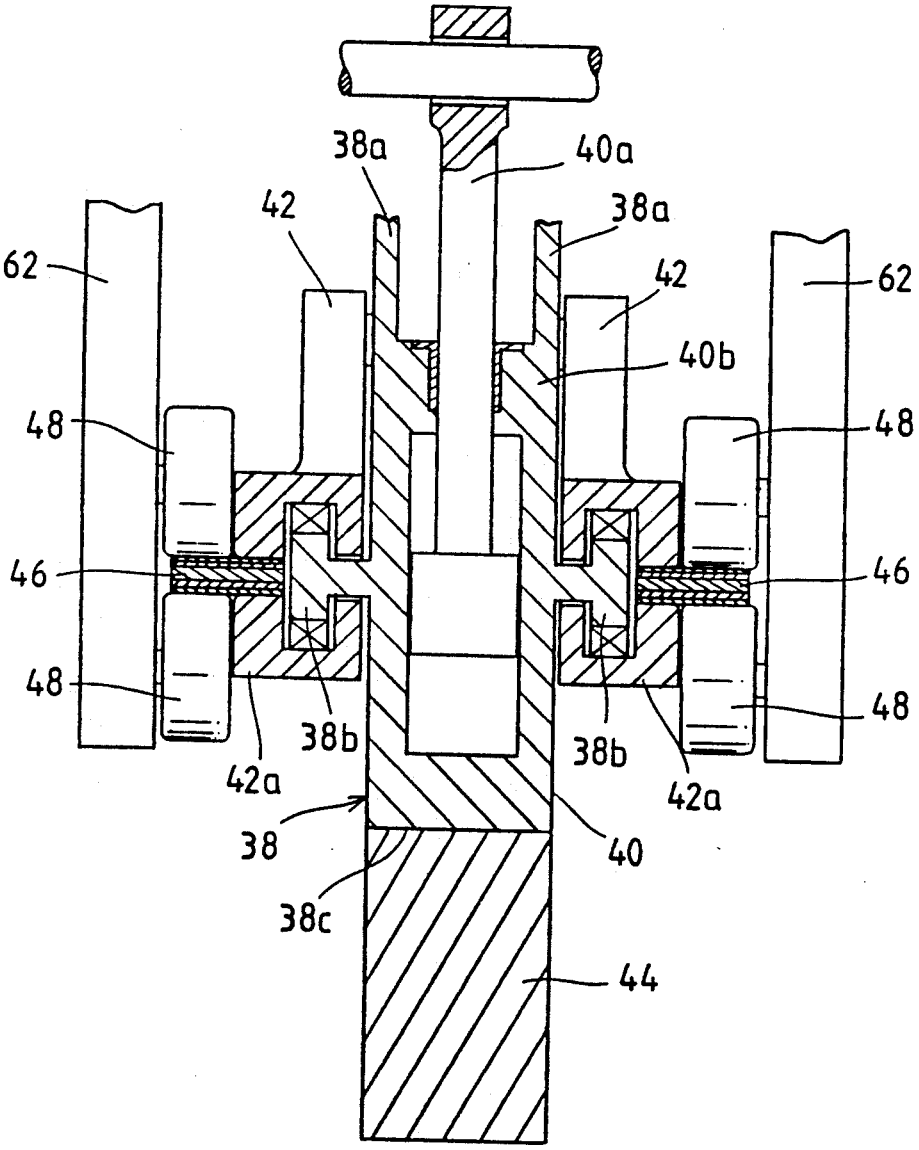
FIG. 4 shows, in vertical cross section, adjustable mold members.

As shown in FIG. 4, a couple of protrusions 38*b* having a T-shaped cross section, which protrude in the transversal direction of the leaf blank 10 are provided at a predetermined height on each side of the barrel 40*b*, and the hinge portion 42*a* of a lever 42 is pivotally fitted on each protrusion 38*b*. The free end of the lever 42 disposed to the adjustable mold member 38 locating adjacent to the reference mold member 36 is pivotally supported onto the reference mold member 36 at the appropriate position. It should be noted that the adjustable mold member 38 connected to the reference mold member 36 through the lever 42 pivotally supports one end of the lever 42 of another adjustable mold member 38 disposed farther from the reference mold body 36 at a position higher than the level of the protrusions 38*b*. More specifically, the respective adjustable mold members 38 arranged in the longitudinal direction of the leaf blank 10 are connected one after another by the piston rods 40*a* and levers 42, respectively. The posture of each adjustable mold member 38 can be changed depending on the length of the piston rod 40*a* protruding from the barrel 40*b*, and its posture is designed to be securely maintained by locking the piston rod 40*a* relative to the barrel 40*b* to fix the imaginary triangles formed by the supporting points C, G, K, 0 of the piston rod, the supporting points E, I, M, Q of the lever 42 and the other supporting points D, H ,L ,P of the lever 42, respectively (see FIG. 5).

Figure 6:
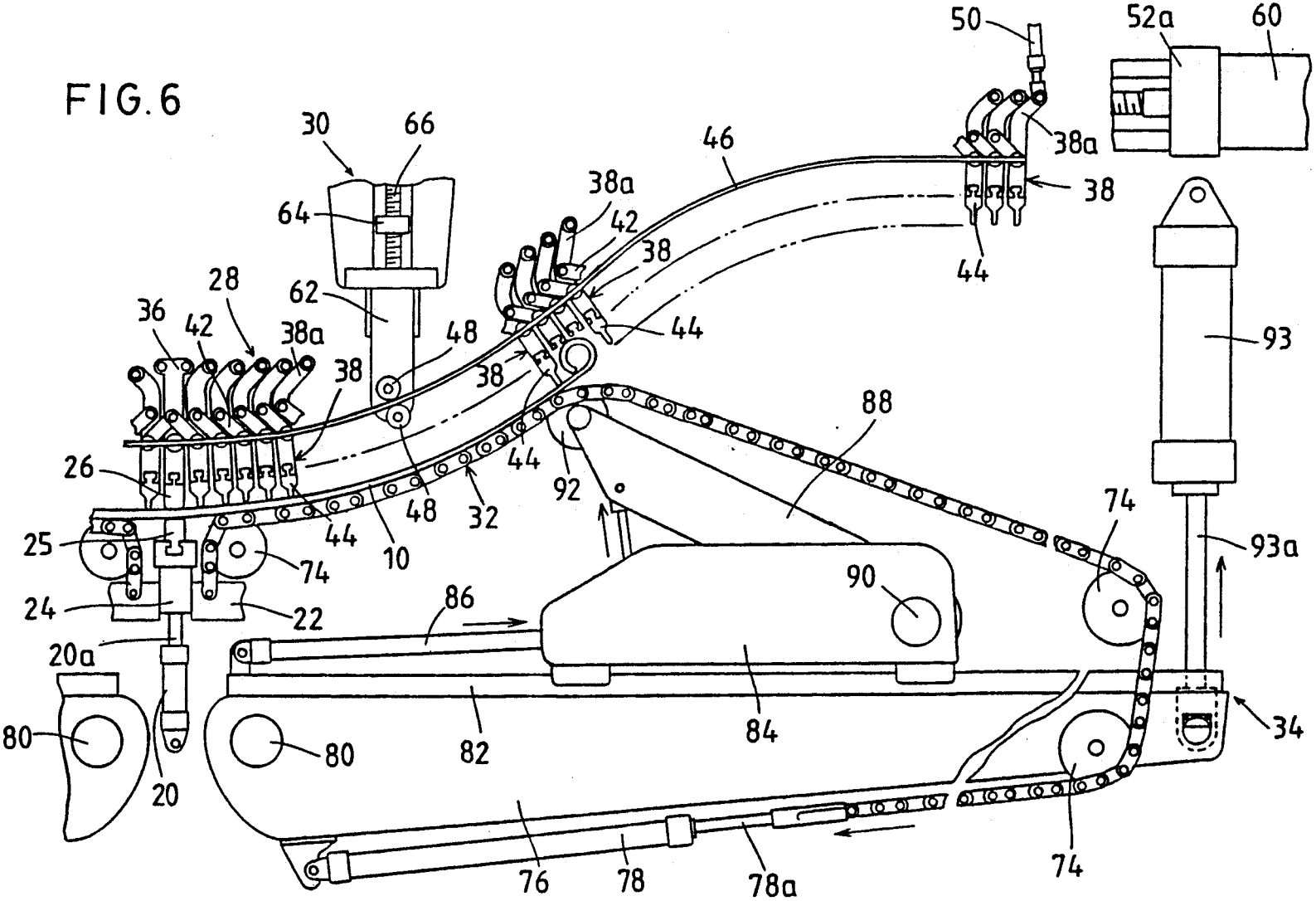
FIG. 6 shows schematically, in partially cutaway constitutional view, the cambering apparatus, where a leaf blank is being cambered into a different profile from that shown in FIG. 2.
Figure 7:
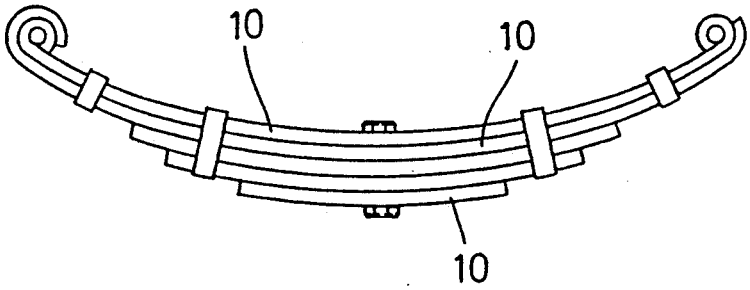
FIG. 7 illustrates a suspension system employing a laminated spring.
Figure 8:
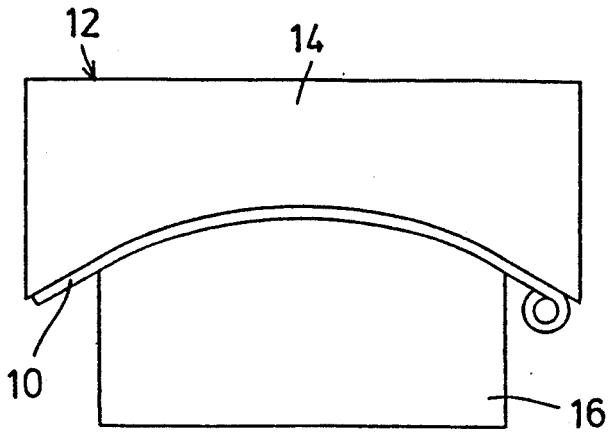
FIG. 8 illustrates a prior art cambering apparatus.

A T-shaped guide groove 38*c* is defined at the bottom (lower end directing to the leaf blank 10) of the barrel 40*b* of each hydraulic cylinder 40 to extend in the transversal direction of the leaf blank 10, as shown in FIG. 3, in which a finger 44 is slidably fitted. A pair of flexible plates 46 are disposed on each side of the row of adjustable mold members 38 and are positioned and fixed to the hinge portions 42*a* of the respective levers 42 in such a way that one longitudinal side portion of each flexible plate may extend outward. The portion of each flexible plate 46 extending outward from the hinge portions 42*a* is designed to be held between a pair of rollers 48 of the reforming device 30. As the flexible plate 46, a laminate in which a plate such as of a fluorocarbon resin or MC nylon is sandwiched between a plurality of steel plates can suitably be used. Such laminate can readily be reformed by the reforming devices 30 and also can retain the reformed shape. Namely, by reforming the camber profile of the flexible plates 46 with the reforming device 30, the posture of each adjustable mold member 38 can be changed in accordance with the change in the camber profile of the flexible plates 46, whereby the lower tips of the fingers 44 of the adjustable mold members 38 present as a whole a continuous curve corresponding to the profile of the flexible plates 46 (see FIGS. 2 and 6). Incidentally, when the desired curve is formed by the fingers 44, the lower tips of the fingers 44 are abutted substantially orthogonally against the leaf blank 10 since the lower tips of the fingers 44 are positioned to be substantially parallel to the centripetal directions of the camber to be imparted to the leaf blank 10 by virtue of the levers 42 connecting the adjustable mold members 38 to one another.

The fingers 44 are designed to be slidable along the guide grooves 38*c*, by a mechanism not shown, to the positions where they are not in contact with the leaf blank 10. Thus, the finger 44 locating at the position corresponding to the location of the eye formed at the end of the leaf blank 10 can be retracted, as shown in FIG. 2, to carry out cambering of the leaf blank 10 with no interference between the eye and the finger 44. If the lower tips of the fingers 44 are worn, they can be removed from the hydraulic cylinders 40 and replaced with new ones.

The arms 38*a* of the adjustable mold member 38 locating at the rightmost position in the group of these members 38 is connected to the piston rod 50*a* of a hydraulic cylinder 50 disposed to a fixed member not shown. The cylinder 50 functions to prevent backlash of the group of adjustable mold members 38, when a predetermined camber profile is formed by them, by operating the cylinder 50 to retract its piston rod 50*a* into the barrel thereof. Incidentally, the number of the hydraulic cylinder 50 for preventing such backlash may not be limited to only one as described in the above embodiment, but plural numbers of cylinders 50 can be disposed at strategic positions.

(Reforming device)

A reforming device 30 for allowing the group of adjustable mold members 38 to form a necessary profile is disposed above the reformable mold 28. More specifically, as shown in FIG. 2, a supporting frame member 52 extends horizontally in the longitudinal direction of the leaf blank 10, and a carriage 56 is slidably disposed to the guide rail 54 extended in the longitudinal direction of the frame member 52. Bearings 52*a* are disposed at the center and the right end of the supporting frame member 52, and a first ball screw 58 is rotatably supported therebetween. The first ball screw 58 is screwed into a nut (not shown) disposed to the carriage 56 and also connected to a first servo motor 60 disposed to the bearing 52*a* locating on the right side. Accordingly, by driving the first servo motor 60 normally or reversely to turn the first ball screw 58, the carriage 56 is allowed to move horizontally along the guide rail 54.

A pair of supporting plates 62 extend downward from the carriage 56 to be spaced from each other in the transversal direction of the leaf blank 10 in such a way that they can be ascended or descended together, and a second ball screw 66 disposed perpendicularly to the carriage 56 is screwed into a nut 64 disposed to these supporting plates 62. A second servo motor 68 is disposed invertedly on the top of the carriage 56, to which the second ball screw 66 is connected. Accordingly, the pair of supporting plates 62 can be ascended or descended vertically by turning the ball screw 66 by driving the second servo motor 68 normally or reversely. On the inner surface of each supporting plate 62 are rotatably supported in a vertical relationship a pair of rollers 48 which hold the corresponding flexible plate 46 therebetween, as shown in FIG. 4. Namely, each of the flexible plates 46 held between the corresponding pair of rollers 48 can be cambered into a desired profile by moving the carriage 56 horizontally by the first servo motor 60 and also moving the supporting plates 62 vertically by the second servo motor 68, whereby the adjustable mold members 38 disposed to the flexible plates 46 assume postures corresponding to the profile imparted to the plates 46 to present as a whole at the free ends thereof a continuous curve corresponding to the profile of said flexible plates 46.

Position detectors 70,72 are disposed respectively to the first servo motor 60 and the second servo motor 68, which detect revolutions of these motors respectively to find the present position of the rollers 48, whereby accurate position of the rollers 48 are constantly monitored. The signals o the location of the rollers 48 from these detectors 70,72 are input, for example, to a control means (not shown) having a built-in microcomputer. Accordingly, if data on the desired camber profiles are preliminarily input to the control means, the driving of the servo motors 60,68 can be controlled based on these data. Thus, a desired camber profile can readily be imparted to the flexible plates 46.

(Variable mold members)

A chain having a predetermined width, constituting a variable mold member 32, is pivotally supported at one end to the fixed member 22 locating adjacent to the positioning cylinder 20, as shown in FIG. 2. The variable mold member 32 is extended over a plurality of sprockets 74 rotatably supported on the machine frame (not shown). The other end of the chain is connected to the piston rod 78*a* of an air cylinder 78 clevis-mounted to the frame 76 (to be described later) of the operating device 34, so that a desired tension can be imparted to the variable mold member 32 by operating the air cylinder 78 to retract its piston rod 78*a* into the barrel thereof. Incidentally, the air cylinder 78 is designed to be constantly urged during cambering of a leaf blank 10 to impart a necessary tension to the variable mold member 32.

(Operating device)

The frame 76 of the operating device 34 extends below the variable mold member 32 in the longitudinal direction of the leaf blank 10, as shown in FIG. 2, and is pivotally supported by a shaft 80 at the end portion adjacent to the location of the positioning cylinder 20. A guide rail 82 is provided longitudinally along the top surface of the frame 76 on which a movable member 84 is slidably disposed. A first cylinder 86 is also clevis-mounted at the bottom thereof onto the top surface of the frame 74 with its piston rod 86*a* being connected to the movable member 84. Namely, the movable member 84 can be moved along the guide rail 82 by operating the first cylinder 86 positively or negatively.

A tilting member 88 is pivotally supported at the right end portion by a shaft 90 onto the movable member 84, which is designed to be tilted on the shaft 90 by a second cylinder 91 disposed to the movable member 84. An operation sprocket 92, which is engaging with the variable mold member 32, is rotatably supported at the free end portion of the tilting member 88. Namely, the operation sprocket 92 can be moved, by operating the first cylinder 86 and the second cylinder 91 under control, in the longitudinal direction and cambering direction of the leaf blank 10 to press the variable mold member 32 extended over the sprocket 92 against the lower surface of the leaf blank 10.

An air cylinder 93 is connected to a fixed member (not shown) with its piston rod 93*a* being connected to the free end portion of the frame 76, so that the frame 76 can be pivoted on the shaft 80 by operating the cylinder 93 positively or negatively. Accordingly, the variable mold member 32 engaging with the operation sprocket 92 is designed to be brought into press contact with the leaf blank 10 with a required pressure by operating the air cylinder 93 to retract its piston rod 93*a* into the barrel thereof and turn the frame 76 counterclockwise whereby to carry out cambering.

Now, actions of the thus constituted cambering apparatus will be described. Before the cambering apparatus 18 is operated, predetermined camber profile data are input to the control means (not shown) provided in the apparatus 18. It should be understood here that the variable mold members 32 are assuming a stand-by posture with the operation sprockets 92 of the operating devices 34 each locating at a position adjacent to the center of the apparatus. Meanwhile, the piston rod 40*a* of the hydraulic cylinder 40 in each adjustable mold member 38 is in a free state where it is movable relative to the barrel 40*b*.

The servo motors 60,68 for driving the reforming devices 30 disposed on each side relative to the center of the apparatus are driven under control based on the input data to move horizontally and vertically each pair of rollers 48 holding the corresponding flexible plate therebetween, whereby to reform the flexible plates 46 into the desired camber profile.

More specifically, in the state where the rollers 48 are approached to the reference mold member 36 in the reformable mold 28, the first serve motors 60 are driven to move the carriages 56 horizontally, and also the second servo motors 68 are driven to ascend vertically the supporting plates 62. Thus, each pair of rollers 48 ascend as they move in the longitudinal direction of the leaf blank 10, whereby the flexible plates 46 held between the respective pairs of rollers 48 are reformed to show a gentle upward curve from the center toward each end. In this process, the piston rod 40*a* of each hydraulic cylinder 40 assuming a free state is allowed to move relative to the barrel 40*b* as the flexible plates 46 are reformed.

Figure 5:
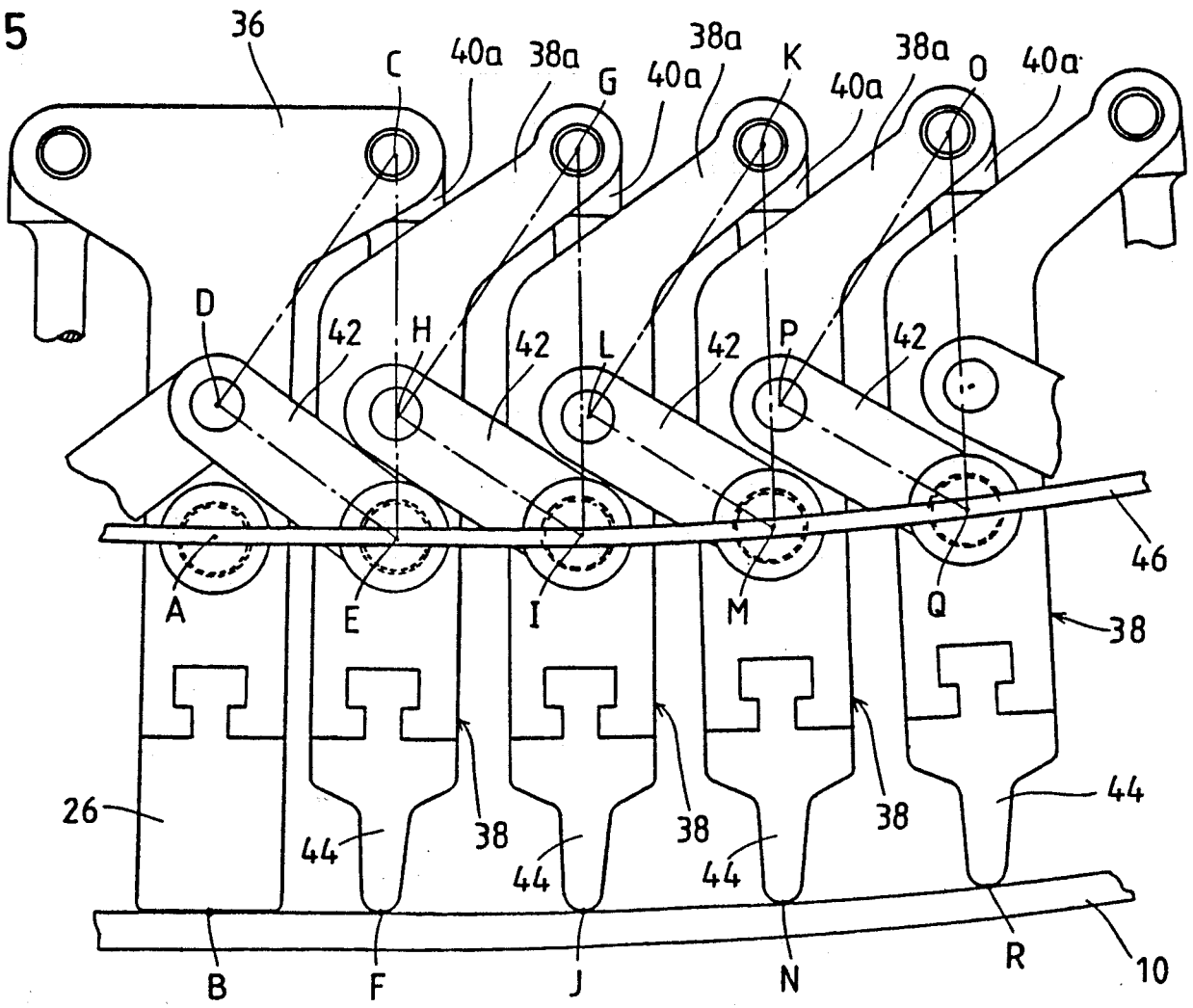
FIG. 5 illustrates the mechanism of positioning and locking each adjustable mold member in the reformable mold.

At the point where the rollers 48 pass the supporting point E of the lever 42 disposed to the adjustable mold member 38 locating adjacent to the reference mold member 36, the piston rod 40*a* of the hydraulic cylinder 40 in said adjustable mold member 38 is positioned and locked to fix the distance between the supporting point C of the piston rod 40*a* onto the reference mold member 36 and the supporting point E (see FIG. 5). Thus, the shape of the imaginary triangle formed by connecting the supporting points C,E, and the supporting point D of the lever 42 onto the reference mold member 36 can be fixed, enabling positioning and locking of the point F at the lower tip of the finger 44 disposed to said adjustable mold member 38. Incidentally, the point A where the reference mold member 36 is connected to the flexible plate 46 and also the point B at the lower tip of the reference finger 26 (the point against which the leaf blank 10 is abutted at the longitudinal center) attached to the reference mold member 36 are also locked.

Then, the rollers 48 are moved diagonally upward and outward by actuating each reforming device 30 to reform the flexible plates 46, whereby the piston rod 40*a* of the adjustable mold member 38 locating adjacent to said positioned adjustable mold member 38 is allowed to move relative to the barrel 40*b* thereof. At the point where the rollers 48 pass the supporting point I, the piston rod 40*a* of the hydraulic cylinder 40 in the corresponding adjustable mold member 38 is positioned and locked to fix the distance between the supporting points G and I. Thus, the shape of the imaginary triangle formed by connecting the supporting points G,I, and the supporting point H of the lever 42 onto the positioned mold member 36 can be fixed, enabling positioning and locking of the point J at the lower tip of the finger 44 attached to said adjustable mold member 38.

By positioning and locking the piston rods 40*a* of the hydraulic cylinders 40 of the corresponding adjustable mold members 38 successively as the rollers 48 pass the points M,Q . . . where the corresponding levers 42 are supported onto the corresponding adjustable mold members 38, the points N,R . . . at the lower tips of the corresponding fingers 44 can be positioned and locked. Thus, each of the adjustable mold members 38 disposed to the flexible plates 46 is positioned and locked conforming to the profile imparted to the plates 46, and the curve formed by connecting the points F,J,N,R . . . at the lower tips of the fingers 44 as a whole presents the same profile. Incidentally, the point at the lower tip of the finger 44 in any adjacent adjustable mold member 38 can be decided with respect to that of the finger locating before it (on the side closer to the reference mold member), even a short stroke hydraulic cylinder 40 can cope with various types of camber profiles.

After the reforming devices 30 are moved respectively to the positions corresponding to the length of the leaf blank 10, the piston rods 40*a* in the rest of the adjustable mold members 38 are positioned and locked, and also the hydraulic cylinders 50 are operated, whereby the group of adjustable mold members 38 are positioned in such a state where backlash thereof is prevented. Incidentally, the fingers 44 locating at the positions corresponding to the eyes formed at each end portion of the leaf blank 10 are preliminarily retracted to such positions where they do not interfere with the leaf blank 10.

Subsequently, a straight leaf blank 10 heated to a predetermined temperature is placed at the longitudinal middle portion onto the supporting finger 25 of the carrier 24 disposed to the positioning cylinder 20. The leaf blank 10 is securely held between the supporting finger 25 and the reference finger 26 disposed to the reference mold member 36 by operating the cylinder 20 to protrude the piston rod 20*a* thereof. In this state, the group of adjustable mold members 38 locating above the leaf blank 10 are forming a predetermined camber profile.

The operation sprockets 92 are ascended as they are moved in the longitudinal direction of the leaf blank 10 by operating the first cylinders 86 of the operating devices 34 to move the movable members 84 outward and also the second cylinders 91 to turn the tilting members 88 upward on the shafts 90. The variable mold members 32 engaging with the sprockets 92 are pressed against the lower surface of the leaf blank 10 as the sprockets 92 move. In this state, since a necessary tension is imparted to the variable mold members 32 by the air cylinders 78 and also the frames 76 of the operating devices 34 are urged to turn upward (in the direction to push the operation sprocket 92 toward the leaf blank 10), the leaf blank 10 is brought into press contact with the group of fingers by the variable mold members 32. Accordingly, the leaf blank 10 is allowed to have the same camber as the one formed by the group of fingers (see FIG. 2). After the operating devices 34 are reset to the stand-by position and the cylinder 20 is operated reversely to descend the carrier 24, the thus cambered leaf blank 10 is unloaded from the cambering apparatus 18 and then forwarded to the next step such as quenching.

In the cases where there is a necessity of forming a leaf blank 10 of a different camber profile in accordance with the order change, e.g. one having a smaller camber radius or one having inverted cambers at each end portion, new camber data are input to the control means (not shown). Thus, the servo motors 60,68 are driven under control to impart a desired camber profile to the flexible plates 46 and allow the group of adjustable mold members to form as a whole the desired continuous curve (see FIG. 6). Namely, only by inputting desired camber profile data to the control means, the desired curve can be formed with the group of adjustable mold members, and thus the change-over time required in accordance with the order change can be reduced to improve productivity. Moreover, the cambering apparatus of the invention enjoys advantages in that the production cost can be reduced and that intricate inventory control can be obviated, since there is no need of providing a number of copes and drags corresponding to the respective types of camber profiles. Besides, if it be found after inspection that the leaf blanks 10 processed in a predetermined lot number are not properly cambered, the camber of these leaf blanks 10 can be corrected in a very short time by operating the reforming devices 30, leading to improvement of productivity.

Since a desired camber profile can readily be reformed in the apparatus of the invention, there is no need of providing a corresponding cope and drag when only one or a very few number of leaf blanks 10 are to be cambered such as in the case of prototype, so that the running cost can be reduced. Meanwhile, the time required for the adjustment of the apparatus can further be reduced if several types of camber profile data are preliminarily input to the control means so as to be able to select the desired camber profile in accordance with the order change by depressing a predetermined setting button.

It should be noted, however, that while the present invention has been described referring to the embodiment where the reformable mold and the variable mold member are disposed respectively above and below the leaf blank, the present invention is not limited to such embodiment, and it is also possible to dispose a pair of reformable molds and a pair of reforming devices each above and below the leaf blank and to allow one reformable mold to be retractable against the other reformable mold. In the above-described embodiment, while a servo motor is employed as a means for driving the reforming device, the present invention is not limited thereto, and a hydraulic pressure cylinder or other mechanism can suitably be employed.

It will be apparent to those skilled in the art that the present invention may be embodied in many other specific forms without departing from the spirit or scope of the invention. Therefore, only the limitations that should be imposed are set forth in the appended claims.

What is claimed is:

1. A cambering apparatus for imparting a predetermined camber to a leaf blank for a laminated spring, comprising:

a reformable mold having a plurality of adjustable mold members connected to one after another in such a way that their postures can be adjusted, each adjustable mold member being able to be locked in a predetermined posture;

a pair of flexible plates disposed on each side of the row of said adjustable mold members and secured by each of them;

a couple of reforming devices each having engageable means for movably engaging with said flexible plates, which impart a required profile to said flexible plates by moving said engageable means in the longitudinal direction of the leaf blank as well as in the camber imparting direction; and a pressing device disposed to oppose said reformable mold, for pressing said leaf blank placed therebetween against the reformable mold;

wherein by imparting a predetermined camber profile to said flexible plates with said reforming devices, the free ends of said adjustable mold members disposed to said flexible plates, opposing to said pressing device, are designed to present as a whole a continuous curve corresponding to the profile of said flexible plates.

2. A cambering apparatus for imparting a predetermined camber to a leaf blank for a laminated spring according to claim 1;

wherein said pressing device consists of a pair of variable mold members disposed to oppose said adjustable mold, the shape of said members being variable conforming to the curve formed at the free ends of said reformable mold; and a pair of operating devices which can move pressing members engaging with said variable mold members in the longitudinal direction of said leaf blank as well as in the camber imparting direction.

3. A cambering apparatus for imparting a predetermined camber to a leaf blank for a laminated spring according to claim 1;

wherein said pressing device consists of a reformable mold disposed to be retractable against the other reformable mold opposing thereto, said former reformable mold also having a plurality of adjustable mold members connected to one after another in such a way that their postures can be adjusted, while each adjustable mold member being able to be locked in a predetermined posture; a pair of flexible plates disposed on each side of the row of said adjustable mold members and secured by each of them; and a couple of reforming devices each having engageable means for movably engaging with said flexible plates, which impart a required profile to said flexible plates by moving said engageable means in the longitudinal direction of said leaf blank as well as in the camber imparting direction.

4. A cambering apparatus for imparting a predetermined camber to a leaf blank for a laminated spring according to claim 1 or 3;

wherein said engageable means of the reforming devices are moved under control by servo means in the longitudinal direction of said leaf blank as well as in the camber imparting direction.

* * * * *

UNITED STATES PATENT AND TRADEMARK OFFICE

CERTIFICATE OF CORRECTION

PATENT NO. : 5,224,370

DATED : July 6, 1993

INVENTOR(S) : Motoo Morita

It is certified that error appears in the above-identified patent and that said Letters Patent is hereby corrected as shown below:

On the title page: Item
[30] Foreign Application Priority Data:

Change "Sep. 24, 1992 [JP] Japan ..... 3-280443"
to --Sep. 24, 1992 [JP] Japan ..... 4-280443--

Signed and Sealed this

Twenty-second Day of March, 1994

*Attest:*

Bruce Lehman

BRUCE LEHMAN

*Attesting Officer*

*Commissioner of Patents and Trademarks*